US005173240A

United States Patent [19]

Irwin

[11] Patent Number: 5,173,240

[45] Date of Patent: Dec. 22, 1992

[54] TENSION-FREE HEAT-TREATMENT OF ARAMID FIBER AND FIBRIDS

[75] Inventor: Robert S. Irwin, Wilmington, Del.

[73] Assignee: E. I. Du Pont de Nemours and Company, Wilmington, Del.

[21] Appl. No.: 692,162

[22] Filed: Apr. 26, 1991

[51] Int. Cl.[5] ..... D01F 6/60

[52] U.S. Cl. ..... 264/345; 264/184; 264/211.17; 264/234

[58] Field of Search ..... 264/234, 345, 211.17, 264/85, 184, 235, 346

[56] References Cited

U.S. PATENT DOCUMENTS 3,386,965 6/1968 Huffman et al. ..... 260/78

4,957,807 9/1990 McCullough, Jr. et al. ..... 428/222

OTHER PUBLICATIONS

Hinderer et al., "Aromatic Copolyamides Containing Pendent Carboxyl Groups", Applied Polymes Symposium No. 21 1-9 (1973).

*Primary Examiner*—Jan H. Silbaugh

*Assistant Examiner*—Catherine Timm

[57] ABSTRACT

Amorphous fibers or fibrids of poly [4,4'-(2,2'-dicarboxy) biphenyleneterephthalamide] are strengthened and heat stabilized by a relaxed heat-treatment. The fiber or fibrids are heated at temperatures in the range of 310° C. to 365° C. and preferably at temperatures above 325° C. but below decomposition temperatures. The heating is conducted for at least 2 minutes, preferably from 5 to 15 minutes. Increases in tenacity of at least 25%, preferably at least 50% or more are attained. The fiber or fibrids are treated while free of ternsion as they would be in a loose batt, woven or knitted fibric or paper.

8 Claims, No Drawings

TENSION-FREE HEAT-TREATMENT OF ARAMID FIBER AND FIBRIDS

RELATED APPLICATIONS

This application is related to my U.S. application Ser. Nos. 07/446,339, now U. S. Pat. No. 5,026,819, and 07/446,338, now U.S. Pat. No. 5,039,785.

BACKGROUND OF THE INVENTION

Oriented para-aramid fibers typified by high strength, high modulus, poly(p-phenylene terephthalamide) fiber show little or no change in tenacity when heated while relaxed or under tension at temperatures of 300°-350° C. Relaxed heating at higher temperatures causes a drop in tenacity. Some oriented polyamide fiber such as poly-1,4-benzamide fiber do strengthen when heated under tension by virtue of a crystallization process which improves molecular orientation significantly. Non-para-aramids such as poly(m-phenylene isophthalamide) will show no change or actually decrease in tenacity on heating whether under tension or relaxed, depending on temperature.

In each situation described above, the maximum fiber tenacity is ordinarily attained before the fiber is incorporated into a fabric or other article. Since the present invention deals with tension-free heat-strengthening of aramid fiber and fibrids, it permits the incorporation of fiber into a fabric or fibrids into a paper and subsequent heat treatment to achieve greater strength.

It is believed that the placement of the substituents in the polymer of the as-spun filaments enables the filaments to be heat-strengthened while closely related materials will not survive the heat treatment of the invention. For example,

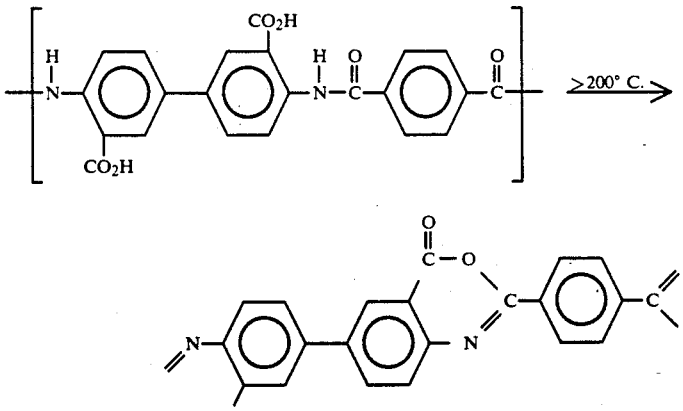

which illustrates thermal cyclization to a class of polymers known as polybenzoxazinones ("Encyclopedia of Polymer Science and Technology" V. 10 pp 682-690, Interscience, N.Y., 1969). In the present invention, this reaction cannot take place, although some dehydration to anhydride may occur upon heat treatment. However, such dehydration does not affect capability of the polymer to form a covalent bond with epoxides and the like.

SUMMARY OF THE INVENTION

The present invention provides a process for strengthening heat stabilizing fibers of poly[4,4'-(2,2'-dicarboxy)biphenyleneterephthalamide, consisting essentially of heating the fibers, free from tension, at a temperature in the range of 310° C. to 365° C. for at least 2 minutes, preferably in an inert atmosphere.

DETAILED DESCRIPTION OF THE INVENTION

This invention is directed to strengthening and heat-stabilizing fibers of poly[4,4'-(2,2'-dicarboxy)diphenyleneterephthalamide (DPA-T). The polyterephthalamide of 4,4'-diaminodiphenic acid

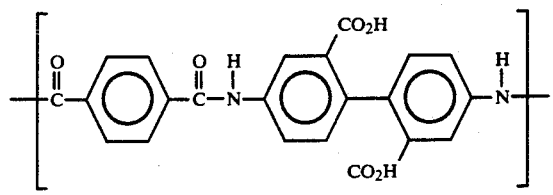

is described along with its preparation in my U.S. application Ser. No. 07/446,338 filed Dec. 5, 1989 now U.S. Pat. No. 5,039,785. The process contemplates heating as-spun fibers of the polymer in a relaxed condition, at a temperature and for a time sufficient to increase the tenacity of the fibers by at least 25% and preferably by at leas&: 50%. The ability to employ a relaxed heat-treatment on the fibers has the advantage of avoiding the need for a more costly hot drawing process step to provide tension. In other cases, as with fibrids, no other way of building up properties may be available since there may be no way to provide tension while heating. By "as-spun" is meant the condition in which the fibers are in prior to relaxed heat treatment. Thus, the fibers may be in the form of a loose batt of staple fibers, a non-woven web, a woven or knitted fabric or some other article form, before being heat-strengthened in said relaxed condition. Also contemplated is the heat-strengthening of coatings, films or fibrids of the polymer and preferably, wet-laid papers containing the fibrids. Presence of the $CO_2H$ groups on the surface of the fiber provides a means for forming strong covalent bonds with resins or binders such as epoxides.

The fiber, film or other extruded articles or fibrids are strengthened and heat-stabilized by heating at temperatures in the range of 310° C. to 365° C. and preferably at temperatures above 325° C. but below decomposition temperatures The heating is conducted for at least 2 minutes, preferably from 5 to 15 minutes. Increases in tenacity of at least 25% and preferably at least 50% and more are readily attained as can be easily measured in the case of fibers. The fiber or fibrids are treated while free of tension as they would be in a loose batt, woven or knitted fabric or paper containing the fibrids. Finally, the heat-treatment is conducted under an inert atmosphere such as nitrogen to minimize degradation.

The as-spun fiber or as-prepared fibrids are amorphous in nature and remain amorphous upon heat-treatment. However, as will be seen by the data presented below, significant changes do occur upon heat-treatment. Tenacity, mentioned previously, increases substantially. The heat-strengthened fibers exhibit improved dimensional stability and much lower moisture regain than is the case with as-spun fibers. This is believed to be due to formation of strong interchain hydrogen bonds via the $CO_2H$ groups.

The polymer may be prepared and spun as follows:

(A) Polymer Preparation

In a thoroughly dry resin kettle fitted with a cage-type stirrer, slow flow of dry nitrogen to exclude moist air, thermometer, and external ice bath cooling, a slurry of 4,4'-diaminodiphenic dihydrochloride acid (15.45 g; 0.0448 mole) with anhydrous dimethylacetamide (282 g; 302 ml) was treated at room temperature with diethylaniline (13.34 g; 0.0896 mole) predried by distillation from $P_2O_5$) to form a clear solution. This was cooled to 10° C. and terephthaloyl chloride (9.09 g; 0.0448 mole) added quantitatively. The resulting viscous solution, after stirring for 2 hr at room temperature, was combined with 2.50 g anhydrous calcium oxide to neutralize HCl of polymerization. The resulting 5-6% DPA-T solution was isotropic at rest but distinctly anisotropic under stress. It had inherent viscosity 7.21, measured at 0.5% solids with dimethylacetamide.

(B) Spinning

The above 5-6% DPA-T dope at 70° C. was expressed by an oil-driven piston, via filtration screens, through a 5-hole spinneret (hole diameter=0.012 cm), through a 1.25-1.86 cm air gap into a coagulating bath of water at 21° C. Fibers were wound up at 41 m/min and a spin-stretch factor of 7.6, under a spray of water to remove solvent traces. After soaking overnight in water, the fiber was allowed to dry out at room temperature. Average (of 5 breaks) tenacity (T), elongation (E), modulus (Mi) and filament denier (dpf) were 2.58 gpd/9.6%/126 gpd/11.6 den. Wide-angle X-ray analysis showed no crystallinity but orientation angle (O.A) was 60.1° . The straw-colored fiber had density of 1.486. Thermomechanical analysis (TMA) indicated a glass transition temperature (Tg) of 302° C. and elongation at 400° C.=4.26%.

TMA was performed using a Du Pont Model 2940 Thermomechanical Analyzer. A fiber specimen in which a length of about 7 mm was marked off, was suspended in a heating chamber. The temperature was raised to beyond 400° C. at a fixed heating rate. Increases in the length of the marked off portion on heating were recorded electronically on a chart. The glass transition temperature is indicated by a distinct change in the rate of dimensional change with temperature.

EXAMPLE 1

Loose bundles of fibers prepared as described above (B) were placed in a nitrogen-filled oven and heated at various temperatures for various times.

The properties shown in Table I were measured on specimens stored in a dessicator at relative humidity of 4%. None of the heat-treated specimens had developed crystallinity.

Only very minor change in length on heating to 400° C. is noted. This is most unusual for a poorly oriented polymer, heated above its glass transition temperature. Pyrolytic decomposition becomes rapid at ~560° C.

TABLE I

PROPERTIES OF DPA-T FIBERS, HEAT-TREATED UNDER ZERO TENSION

| Heat Treatment | dpf | T** | E (%) | Mi** | Toughness | O.A. | Moisture* Content (Dried) | TMA Tg | TMA Elong. at 400° C. |
|---|---|---|---|---|---|---|---|---|---|
| As-spun | 11.0 | 2.58 | 9.6 | 126 | 0.20 | 60.1 | 17.1% | 302° C. | 4.26% |
| 100° C./3 hr | 9.4 | 2.32 | 5.7 | 121 | 0.10 | 60.4 | 11.0% | 290° C. | 3.27% |
| 200° C./30 min | 11.6 | 2.32 | 10.9 | 120 | 0.21 | 57.8 | 12.0% | 263° C. | 4.00% |
| 300° C./15 min | 8.2 | 2.31 | 11.3 | 130 | 0.21 | 55.6 | 7.1% | 275° C. | 2.25% |
| 325° C./6 min | 13.0 | 3.49 | 8.8 | 138 | 0.23 | 58.9 | 6.3% | 280° C. | 1.70% |
| | 13.0 | 2.87 | 7.5 | 123 | 0.16 | | | | |
| 350° C./10 min | 9.5 | 4.28 | 6.8 | 142 | 0.19 | 53.2 | 2.7% | 267° C. | 0.71% |
| 350° C./25 min | 17.3 | 1.69 | 2.0 | 118 | 0.02 | 54.5 | 5.0% | 288° C. | 0.84% |

*By heating at 110° C. until constant weight is reached.
**In grams per denier (gpd)

I claim:

1. A process for strengthening and heat stabilizing fibers of poly[4,4'-(2,2'-dicarboxy)biphenyleneterephthalamide], consisting essentially of heating the fibers, free from tension, at a temperature in the range of from 210° C. to 365° C. for at least 2 minutes to increase the tenacity of the fibers by at least 25%.

2. A process according to claim 1 wherein the fibers to be treated are in a fabric.

3. A process according to claim 1 wherein heating is continued for from 5 to 15 minutes.

4. A process according to claim 1 wherein heating takes place in an inert atmosphere.

5. A process for strengthening and heat stabilizing fibrids of poly[4,440 -(2,2'-dicarboxy)biphenyleneterephthalamide] consisting essentially of heating the fibrids, free from tension, at a temperature in the range of from 310° C. to 365° C. for at least 2 minutes.

6. A process according to claim 5 wherein the fibrids to be treated are in a paper.

7. A process according to claim 5 wherein heating is continued for from 5 to 15 minutes.

8. A process according to claim 5 wherein heating takes place in an inert atmosphere.

* * * * *

UNITED STATES PATENT AND TRADEMARK OFFICE

CERTIFICATE OF CORRECTION

PATENT NO. : 5,173,240

DATED : December 22, 1992

INVENTOR(S) : Robert Samuel Irwin

It is certified that error appears in the above—identified patent and that said Letters Patent is hereby corrected as shown below:

Col. 4, line 47, delete "210°" and replace with --310°--.

Col. 4, line 56, after poly[4, delete "440" and replace with --4'--.

Signed and Sealed this

First Day of February, 1994

Bruce Lehman

BRUCE LEHMAN

*Commissioner of Patents and Trademarks*

*Attest:*

*Attesting Officer*